US005221874A

United States Patent [19]

Dayton

[11] Patent Number: 5,221,874

[45] Date of Patent: Jun. 22, 1993

[54] ELECTRIC LAMP HAVING LEAD-THROUGHS CLAMPED AND WELDED TO LAMP CAP CONTACTS

[75] Inventor: David R. Dayton, Stuart, Fla.

[73] Assignee: North American Philips Corporation, New York, N.Y.

[21] Appl. No.: 919,008

[22] Filed: Jul. 23, 1992

Related U.S. Application Data

[63] Continuation of Ser. No. 603,600, Oct. 25, 1990, abandoned.

[51] Int. Cl.[5] ..... H01J 5/48; H01J 5/50

[52] U.S. Cl. ..... 313/318; 362/362; 439/611; 439/881

[58] Field of Search ..... 313/318, 49, 51; 439/611, 612, 877, 881; 362/362

[56] References Cited

U.S. PATENT DOCUMENTS

| | | | |
|---|---|---|---|
| 3,524,693 | 8/1970 | Kubo et al. | 313/318 X |
| 4,146,814 | 3/1979 | Wojtowicz | 313/220 |
| 4,528,619 | 7/1985 | Dolan et al. | 313/318 X |
| 4,571,019 | 2/1986 | Arai | 439/881 |
| 4,687,965 | 8/1987 | Sanders et al. | 313/318 |
| 4,864,185 | 9/1989 | Dayton et al. | 313/318 |

FOREIGN PATENT DOCUMENTS

| | | |
|---|---|---|
| 2835727 | 2/1980 | Fed. Rep. of Germany . |
| 585670 | 2/1947 | United Kingdom . |

*Primary Examiner*—Donald J. Yusko
*Assistant Examiner*—Ashok Patel
*Attorney, Agent, or Firm*—Brian J. Wieghaus

[57] ABSTRACT

An electric lamp having a light source disposed in a light transmissive envelope, conductive lead-throughs extending from said light source through the envelope to the exterior, and a lamp base having a pair of contact terminals connected to the lead-throughs by clamping between two clamping portions of the terminals and welding of the clamping portions at two opposing surfaces of the lead-through. The terminals have a plating with a melting point low enough such that the plating forms a brazed joint with the lead-through when a welding current from a resistance welder is passed through the clamping portions and the respective lead-through.

20 Claims, 2 Drawing Sheets

ELECTRIC LAMP HAVING LEAD-THROUGHS CLAMPED AND WELDED TO LAMP CAP CONTACTS

This is a continuation of U.S. Ser. No. 603,600, filed Oct. 25, 1990 now abandoned.

BACKGROUND OF THE INVENTION

1) Field of the Invention

The invention relates to electric lamps and, more particularly, to the mechanical and electrical connection between the conductive lead-throughs which extend from the lamp envelope and the contact terminals of the lamp cap.

2) Description of the Prior Art

Electric lamps generally have a sealed lamp envelope or bulb in which a light source, such as a filament or arc tube, is disposed and conductive lead-throughs extending from the light source through the lamp envelope to the exterior. A lamp cap or base secured on the lamp envelope and having one or more contact terminals connected to corresponding lead-throughs provides electrical connection to the light source from an associated socket.

In lamps having planar contact terminals the lead-throughs are most often fastened to the contact terminals by welding or by crimping. As used hereinafter, a "weld" is defined as a localized coalescence of metal wherein coalescence is produced by heating to suitable temperatures, with or without the application of pressure, and with or without the use of filler material. The filler material may have a melting point similar to the base metals, or lower than the base metals but above approximately 840° F. This definition includes resistance welding, brazing, and braze-welding, among others.

U.S. Pat. No. 4,146,814 (Wojtowicz) discloses a single-ended miniature incandescent lamp having a two-piece metallic clip-type base. Wojtowicz teaches that the two leg portions of the clip may be connected to the lead-throughs by welding or by crimping. U.S. Pat. No. 4,687,965 (Sanders et al) shows a type 9005/9006 automotive head lamp having an insulative base of synthetic material in which planar tongue-shaped contact terminals are disposed. The lead-throughs are fastened to the terminals by welding. To increase the strength of the welds, Sanders teaches terminals having a raised ridge or rib, extending normal to the lead-through, to which the lead-through is welded. The welding current then passes through a "point-shaped" contact area between the lead-through and the rib, concentrating the welding current at one spot, and increasing the strength of the weld. This is in contrast to the prior technique of welding the lead-through to a flat surface of the terminal in which the welding current passed through a "line-shaped" larger area, which produced a weaker weld.

Weld failures have been known to occur in service, causing failure of the lamp. It is believed that the factors contributing to the weld failures include forces on the welds during lamp service, corrosion, chemical attack, and also initial defects in the welds during manufacture.

In lamps having contact terminals disposed in a lamp cap of synthetic material, such as Sanders above, the terminals are often secured within slots in the cap by means of barbed hooks and/or resilient tongues. It has been found that in service, forces on the lamp cap and the associated socket cause movement of the terminals with respect to the lamp cap and lead-throughs. This movement has been known to cause failure of the welds between the terminals and lead-throughs, even with the improved weld taught by Sanders.

The welds may also be weakened by corrosion from water, dirt, dust, and/or road salts which may infiltrate the lamp cap during service. In lamps where the welds are protected from the environment, as in the Sanders lamp above in which the lead-throughs and terminals are protected by a cover and a synthetic sealing material, such as silicone rubber, it has been found that chemicals, such as ascetic acid, from the sealing materials chemically attack the welds, contributing to their failure.

Additionally, the strength of the welds may be limited initially because the available materials for the lead-throughs and the contact terminals may be restricted. For example, for 9005/9006 type automotive headlamps as shown in Sanders, SAE standard J580 limits the permissible voltage drop in the contact terminals, with the result that the lead-through and contact terminal materials may be less than optimally compatible from a welding standpoint.

Another factor which contributes to unsatisfactory welds when resistance welding is used is equipment and/or operator error in aligning the welding electrodes with the lead-through, causing insufficient welding current to flow through the contact area between the lead-through and the contact terminal.

Accordingly, it is an object of the invention to provide an electric lamp having a strengthened mechanical and improved electrical connection between the conductive lead-throughs and the contact terminals of the lamp base or cap.

It is another object of the invention to provide an electric lamp in which the reliability of the connection between the lead-throughs and the terminals is increased by reducing the possibility of operator/ welding equipment error.

It is yet another object of the invention to provide an improved connection which is cost effective.

SUMMARY OF THE INVENTION

The lamp according to the invention has a light source disposed within a light transmissive envelope and conductive lead-throughs extending from the light source through the envelope to the exterior. A lamp cap is disposed on the envelope and has a contact terminal connected to a corresponding lead-through. The terminal has first and second clamping portions which clamp the lead-through therebetween at two opposing surfaces of the lead-through, and the first and second clamping portions are welded to the lead through at the two opposing lead-through surfaces.

The construction according to the invention results in increased strength of the connection because the lead-through is connected to the terminal by two welds instead of one. Additional strength and reliability is provided by reason of the lead-through being clamped between the first and second clamping portions. The clamping provides back-up mechanical and electrical connection in the event of a deficient weld and also prevents failure of the welds caused by movement of the terminals in the lamp cap by reason of the additional clamping force.

According to an embodiment of the invention, the terminal contacts comprise a metal plating adjacent the lead-through effective as a filler material for forming a brazed joint between the lead-through and the clamping portions of the contact terminal. During heating to form the brazed joint, the metal plating flows, wetting the surface of the lead-through, and coalesces with the lead-through and the terminal upon cooling of the terminal below the melting point of the plating. In addition to the increased mechanical strength, the increased contact surface area of the metal plating with the lead-through provides improved electrical contact.

Preferably, the two clamping portions have plated faces which contact each other with clamping force adjacent the lead-through. The plated faces are heated sufficiently adjacent the lead-through such that the metal plating of the two clamping portions coalesce with each other, locking the clamping portions together.

According to a preferred embodiment of the invention, the contact terminals have a plating selected from the group consisting of tin and nickel. Preferably, the terminals consist of a material selected from the group consisting of nickel-plated brass, nickel-plated cupro-nickel, tin-plated brass, or tin-plated cupro-nickel. Alternatively, the terminals may consist of brass. By using the above materials, the joint between the clamping portions and the lead-through and/or between the two clamping portions may be obtained in an automotive lamp while keeping the voltage drop in the terminals during lamp operation within the above-mentioned SAE standards for voltage drop in the terminals.

According to another preferred embodiment of the invention, the lead-throughs consists of molybdenum, which provides an effective gas-tight seal with a hard glass or quartz glass envelope.

The contact terminals according to another embodiment are tongue-shaped, formed from a planar strip of conductive metal. The first and second clamping portions of the terminal are joined by an elbow at an acute angle. The clamping portions are also preferably at an end of the terminal. This construction is advantageous because during assembly the corresponding lead-through is positioned between the two clamping portions and the welding electrodes of a resistance welder may be used to close the clamping portion, clamping the lead-through therebetween. The welding electrode need not contact the lead-through directly, but may contact the clamping portions adjacent the lead-through while still obtaining current passage through and heating of the lead-through to obtain a satisfactory weld or braze. Accordingly, less precision is required in positioning the welding electrode as compared to the prior art in which the welding electrode had to contact the lead-through itself.

According to another embodiment of the invention, a clamping portion comprises a raised rib extending across the respective lead-through. In addition to concentrating the welding current to facilitate localized heating at the lead-through, the raised rib is more readily deformable around the lead-through than a flat surface and was found to provide an effective clamp with the lead-through.

DESCRIPTION OF THE PREFERRED EMBODIMENTS

Figure 1:
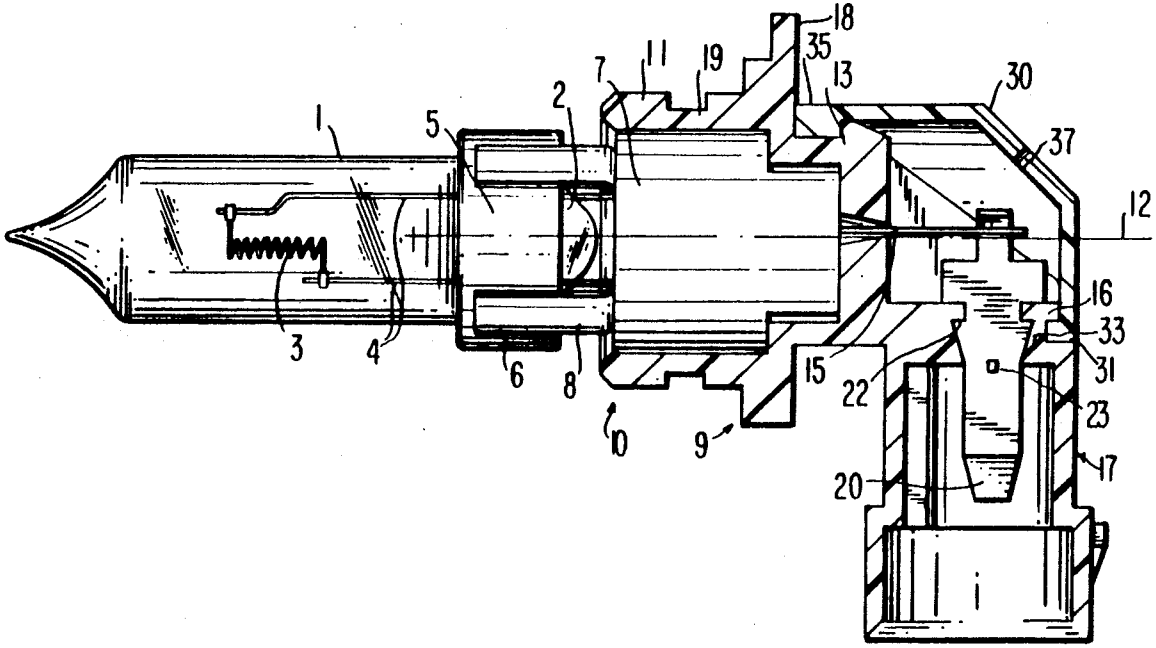
FIG. 1 is a side elevation of an embodiment of the invention with a lamp cap in longitudinal sectional view.

FIG. 1 shows a 9005/9006 type automotive head lamp having a light transmissive lamp envelope 1 of hard glass or quartz glass, which is filled with a gas and has a vacuum-tight press seal 2. A light source, consisting of filament 3, is arranged inside the lamp vessel and is connected to conductive lead-throughs 4 which extend through the wall of the lamp envelope to the exterior. The press seal 2 of the envelope is secured in an opening of a metal clamping plate 5 by means of lugs on the clamping plate, not shown.

A lamp cap 9 of synthetic material has a first cup-shaped housing portion 10 having a substantially circular cylindrical wall portion 11 which defines a lamp axis 12. The portion 10 is closed by a wall 13, through which the lead-throughs 4 extend substantially parallel to the lamp axis. The clamping plate 5 has a circular-cylindrical edge 6 which is joined telescopically by the first end 8 of a circular cylindrical sleeve 7 and is fixed thereto by welding. The sleeve 7 is secured within the first housing portion 10 by means of projecting lugs 15 which extend through apertures in the wall 13 and are twisted to lock the sleeve 7 in the lamp cap. The sleeve may be secured by other means, such as gluing, or heating the sleeve to a sufficient temperature such that it bonds with the synthetic material of the cap. The clamping plate 5 and sleeve 7 comprise means for aligning and securing the lamp envelope to the lamp cap.

The lamp cap 9 has a second housing portion 17 which extends normal to the first portion 10 and is closed at one end by wall 16. Planar tongue-shaped contact terminals 20, 21, extending normal to lamp axis 12, are introduced into the wall 16 through slots in the wall and are secured therein by barbed hooks 22 and resilient tongues 23.

The space between the walls 13 and 16 is closed by a cover 30. Cooperating protrusions 31 and groove 33, and snap connection 35, hold the cover in place. Through the opening 37 in the cover, the closed space can be filled, for example, with a silicone rubber sealing material.

The lamp cap 9 is provided with a profiled collar 18, which ensures correct positioning of the lamp cap in its associated reflector, and with a groove 19 which receives an O-ring for providing a water-tight seal with the reflector. The telescoping connection between the clamping ring 5 and sleeve 7 allows alignment of the filament 3 with respect to the lamp cap 9 to ensure optimum optical performance in a reflector. The above features are conventional.

Figure 2:
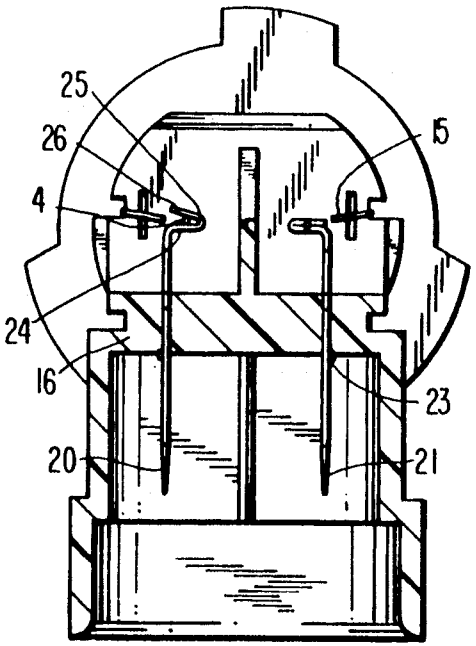
FIG. 2 is a sectional view taken on the line I—I in FIG. 1.

The improvements according to the invention concern the mechanical and electrical connection between the conductive lead-throughs 4 and the terminals 20, 21. As shown in FIG. 2, the terminals 20, 21 of the lamp according to the invention have a first and second clamping portions 24, 26 between which the ends of lead-throughs 4 are secured. For the purpose of illustration, the terminal 21 shows the shape of the terminal prior to welding and clamping of the lead-throughs 4, while terminal 20 shows the terminal in the completed state of the connection. Prior to welding, the clamping portions are joined at an acute angle by elbow 25.

Figure 3:
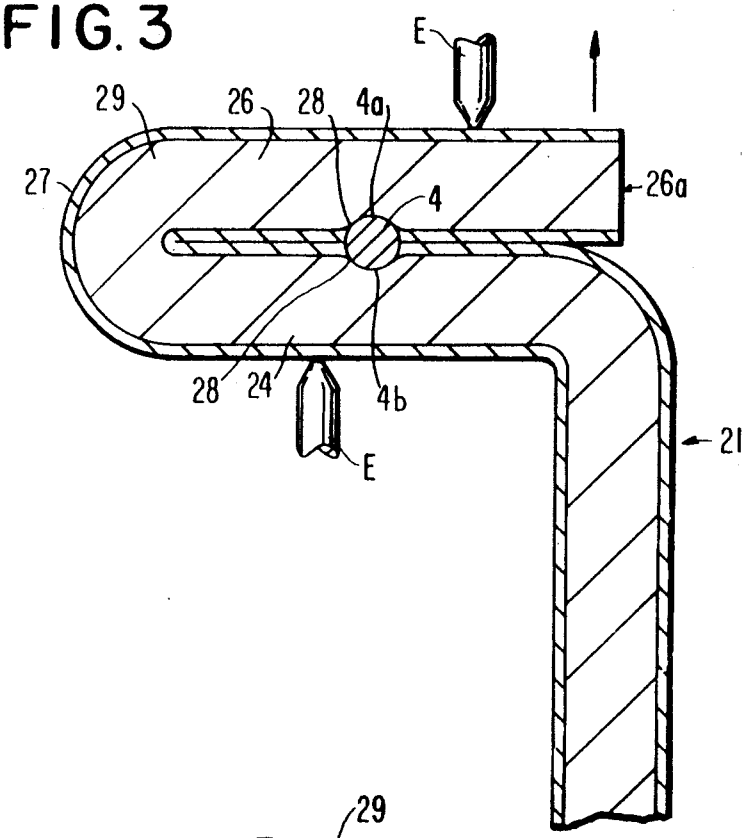
FIG. 3 is an enlarged side elevation of the contact terminals shown in FIGS. 1 and 2.

After insertion of the terminals through the slots in wall 16, the end of the corresponding lead-through 4 is placed between the clamping portions. The clamping portions are then squeezed together to clamp the lead-through therebetween at two opposing surfaces 4*a*, 4*b* of the lead-through. The clamping force is evident by the indentation of the lead-through in the clamping portions (FIG. 3). The clamping portions are then welded to the respective lead-through, preferably by resistance welding to localize the heat generated and because resistance welding is readily automated. The clamping portions 24, 26 may be squeezed by any convenient tool. However, squeezing the clamping portions by the welding electrodes 40 has been found to be more efficient. With the welding electrodes in contact with the clamping portions, a welding current is passed between the electrode tips through the two clamping portions and the lead-through, welding the lead-through to the two clamping portions. This construction provides a stronger and more reliable connection over the prior art single weld because the lead-through is secured by two welds at opposing surfaces thereof and also by the clamping force of the two clamping portions. The terminals may consist of, for example, brass.

In addition to the extra weld surface and clamping force, the clamping portions facilitate reliable welding because it is not necessary for the welding electrodes to be aligned with and contact the lead-through. The welding electrodes may be positioned less critically on the clamping portions adjacent the lead-through and sufficient welding current will still flow through the lead-through to obtain a satisfactory weld.

According to the preferred embodiment of the invention, the terminals 20, 21 consist essentially of nickel-plated brass, nickel-plated cupro-nickel, tin-plated brass, or tin-plated cupro-nickel. The plating 27 on the terminal has a melting point similar to or below that of the base metal 29 of the terminal. When the electrodes of resistance welder are applied to the clamping portions and a welding current effected through the clamping portions and the lead-through, the plating melts and flows around and wets the surface of the lead-through. As shown in FIG. 3, upon cooling of the terminal, the plating coalesces with lead-through 4 forming a brazed joint between the lead-through and the clamping portions. Fillets 28 of the plating material extend between the lead-through 4 and the clamping portions 24,26. Preferably, the clamping portions are pressed together on either side of the lead-through during clamping such that the metal plating of the facing surfaces of the clamping portions are in contact. If the welding electrodes "E" are offset laterally on either side of the lead-through (FIG. 3), the clamping portions are heated sufficiently in the area adjacent the lead-through such that the metal plated surfaces coalesce, forming a welded joint between the metal plated surfaces in the region adjacent the lead-through. This further increases the strength of the connection between the lead-through and the terminal and reduces the criticality of welding electrode placement.

Figure 4:
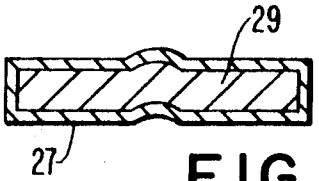
FIG. 4 shows a cross-section of a clamping portion according to a preferred embodiment of the invention.

In the lamp shown in FIG. 1, the terminals consisted of nickel-plated cupro-nickel having a thickness of 0.033 inches and a plating thickness of 0.00003 to 0.00007 inches. Each of the clamping portions had a raised ridge having a height of approximately 0.010 inches according to the cross-section shown in FIG. 4. The lead-throughs were molybdenum having a diameter of 0.6 mm. The melting point of the nickel plating was approximately 2250° F. and that of the cupro-nickel base material was approximately 2650° F. The melting point of the molybdenum lead-through was approximately 4750° F.

The strength of the joint was tested by bending the free-end 26*a* of the clamping portion in the direction shown by the arrow in FIG. 3. It was found that the brazed joint between the lead-through and clamping portions was strong enough that the clamping portion 26 fractured adjacent the lead-through without failure of the brazed joint between the lead-through and the clamping portions.

While there has been shown what are presently considered to be the preferred embodiments of the invention, it will be apparent to those of ordinary skill in the art that various changes and modifications can be made to the filament insert and lamp without departing from the scope of the invention as defined by the appended claims. For example, the clamping portions may be provided on the open ends of pin-shaped electrodes, which are often rolled from a strip of metallic material. Additionally, the terminals may be provided in double-ended lamps having a lamp cap at each end, each with a single terminal as in tubular incandescent lamps, or each with two terminals as in tubular fluorescent lamps.

What we claim is:

1. In an electric lamp comprising a light transmissive envelope, a light source arranged within said envelope, conductive lead-throughs connected to said light source and extending through said envelope to the exterior, and a lamp cap disposed on said envelope and having metallic contact terminals each connected to a respective lead-through of said lead-throughs exterior to said envelope, the improvement comprising:

each said terminal having first and second straight clamping portions, elongate with respect to the diameter of said respective lead-through, for clamping said respective lead-through therebetween, said clamping portions having respective opposing straight planar faces in clamping contact with opposite circumferential sides of said respective lead-through and extending beyond two lateral sides of said respective lead-through and biased together adjacent thereto, each of said planar faces having a metal plating which, upon a passage of a sufficient electric welding current through said clamping portions and said respective lead-through for melting said metal plating, is effective for wetting and coalescing with said respective lead-through to form a brazed joint between a respective circumferential side of said opposite circumferential sides of said respective lead-through and each of said clamping portions and between said planar faces of said clamping portions on both of said lateral sides of said respective lead-through to form a brazed joint therebetween.

2. In an electric lamp according to claim 1, wherein said straight clamping portions of each said terminal are connected by a flexible elbow portion of said each terminal which permits said clamping portions to pivot together under force about said elbow portion from an initial position, in which said clamping portions extend at an acute angle to each other for receiving a respective said lead-through therebetween, to a clamping position in which said clamping portions clamp said respective lead-through therebetween.

3. In an electric lamp as claimed in claim 2, wherein each said terminal consists essentially of a material selected from the group consisting of nickel-plated brass, nickel-plated cupro-nickel, tin-plated brass, and tin-plated cupro-nickel.

4. In an electric lamp as claimed in claim 3, wherein each said lead-through consists essentially of molybdenum.

5. In an electric lamp as claimed in claim 2, wherein said metal plating is selected from a group consisting of nickel and tin.

6. In an electric lamp as claimed in claim 5, wherein said metal plating is selected from a group consisting of nickel and tin.

7. In an electric lamp as claimed in claim 1, wherein said metal plating is selected from a group consisting of nickel and tin.

8. In an electric lamp as claimed in claim 1, wherein each said terminal consists essentially of a material selected from the group consisting of nickel-plated brass, nickel-plated cupro-nickel, tin-plated brass, and tin-plated cupro-nickel.

9. In an electric lamp as claimed in claim 1, wherein each said lead-through consists essentially of molybdenum.

10. A capped electric lamp, comprising:

an electric lamp comprising a light transmissive envelope having a wall and a press seal sealing said envelope in a gas-tight manner, a filament arranged in said envelope, and conductive lead-throughs extending from said filament through said envelope wall to the exterior for energizing said filament to emit light;

an insulative lamp cap of synthetic material including a first housing portion having a substantially circular-cylindrical wall portion defining a lamp axis and being closed by an end wall, and a second housing portion extending normal to said lamp axis, said lead-throughs extending through said end wall adjacent said second housing portion;

lamp alignment means engaging said substantially circular-cylindrical wall portion for securing and aligning said lamp relative to said lamp cap;

planar tongue-shaped terminals being secured in said second housing portion, each of said terminals having first and second straight clamping portions, elongate with respect to the diameter of a respective lead-through, clamping said respective lead-through therebetween, said clamping portions having respective opposing straight planar faces in clamping contact with opposite circumferential sides of said respective lead-through and extending beyond two lateral sides of said respective lead-through and biased together adjacent thereto, each of said planar faces having a metal plating which, upon a passage of a sufficient electric welding current through said clamping portions and said respective lead-through for melting said metal plating, is effective for wetting and coalescing with said respective lead-through to form a brazed joint between a respective circumferential side of said opposite circumferential sides of said respective lead-through and each of said clamping portions and between said planar faces of said clamping portions on both of said lateral sides of said lead-through to form a brazed join therebetween.

11. A capped electric lamp according to claim 10, wherein said straight clamping portions of each said terminal are connected by a flexible elbow portion of said terminal which permits said each clamping portions to pivot together under force about said elbow portion from an initial position, in which said clamping portions extend at an acute angle to each other for receiving a respective said lead-through therebetween, to a clamping position in which said clamping portions clamp said respective lead-through therebetween.

12. A capped electric lamp as claimed in claim 11, wherein each said terminal consists essentially of a material selected from the group consisting of nickel plated brass, nickel-plated cupro-nickel, tin-plated brass, and tin-plated cupro-nickel.

13. A capped electric lamp as claimed in claim 12, wherein said lead-through consists essentially of molybdenum.

14. A capped electric lamp as claimed in claim 11, wherein said metal plating is selected from a group consisting of nickel and tin.

15. A capped electric lamp as claimed in claim 14, wherein said lead-through consists essentially of molybdenum.

16. A capped electric lamp as claimed in claim 10, wherein said lead-through consists essentially of molybdenum.

17. A capped electric lamp as claimed in claim 10, wherein each said terminal consists essentially of a material and are selected from the group consisting of nickel plated brass, nickel-plated cupro-nickel, tin-plated brass, and tin-plated cupro-nickel.

18. A capped electric lamp as claimed in claim 17, wherein said lead-through consists essentially of molybdenum.

19. A capped electric lamp as claimed in claim 10, wherein said metal plating is selected from a group consisting of nickel and tin.

20. A capped electric lamp as claimed in claim 19, wherein said lead-through consists essentially of molybdenum.

* * * * *